US005485992A

United States Patent [19]

Albert et al.

[11] Patent Number: 5,485,992

[45] Date of Patent: Jan. 23, 1996

[54] FOLDER APPARATUS

[75] Inventors: Kevin F. Albert, Barrington; Louis J. Doucet, Salem; Richard L. McKrell, Rye, all of N.H.

[73] Assignees: Heidelberger Druckmaschiner AG, Heidelberg, Germany; Heidelberg Harris, Inc., Dover, N.Y.

[21] Appl. No.: 273,043

[22] Filed: Jul. 8, 1994

[51] Int. Cl.[6] ..... B15H 9/14

[52] U.S. Cl. ..... 271/299; 271/198; 271/315; 271/188

[58] Field of Search ..... 271/299, 198, 271/314, 315, 188, 272, 273, 274; 270/13, 39, 47, 60

[56] References Cited

U.S. PATENT DOCUMENTS

| | | | |
|---|---|---|---|
| 4,244,565 | 1/1981 | Geier | 271/315 X |
| 4,373,713 | 2/1983 | Loebach | 271/302 X |
| 4,593,896 | 6/1986 | Nakamura | 271/315 X |
| 4,925,173 | 5/1990 | Lindslom et al. | 271/315 X |
| 4,925,179 | 5/1990 | Breton et al. | 271/315 X |
| 4,955,964 | 9/1990 | Hain | 271/302 X |
| 5,180,160 | 1/1993 | Belanger et al. | 271/315 |
| 5,249,791 | 10/1993 | Belanger et al. | 271/315 X |

FOREIGN PATENT DOCUMENTS

| | | | |
|---|---|---|---|
| 0527317 | 2/1993 | European Pat. Off. | 271/315 |
| 0280087 | 6/1990 | Germany | 271/315 |
| 0037657 | 2/1986 | Japan | 271/315 |
| 0127558 | 5/1989 | Japan | 271/315 |

*Primary Examiner*—William E. Terrell
*Assistant Examiner*—Carol L. Druzbick
*Attorney, Agent, or Firm*—Kenyon & Kenyon

[57] ABSTRACT

A folder apparatus is disclosed which has at least two side-by-side lead-in tape mechanisms having a left lead-in tape and left exit roller and a corresponding right lead-in tape and right exit roller, the right and left lead-in tapes forming a signature passage for delivery of a signature, and the left exit rollers being at a different height than the right exit rollers. The rollers of the side-by-side tape mechanisms have alternating heights. The exit rollers may be fixed or spring-loaded in the direction of the corresponding roller.

10 Claims, 4 Drawing Sheets

FOLDER APPARATUS

FIELD OF THE INVENTION

The invention relates generally to printing presses and more particularly to a folder apparatus for a printing press for delivering signatures.

BACKGROUND OF THE INVENTION

Lead-in tape systems are commonly used to deliver signatures from a printing press to a stack. A lead-in tape system typically comprises a plurality of lead-in tape mechanisms spaced apart from one another and located side-by-side to one another to contact the signature across its width. Each lead-in tape mechanism has a lead-in tape on one side and a corresponding counter-rotating lead-in tape on the other side to form a signature passage, so that the signature is grasped on both sides and may be transported through the signature passage. Often the signature leaves the signature passage and enters a fan which receives the signature in a fan pocket. The signature is then delivered to a stack as the fan rotates. As described in U.S. Pat. No. 5,112,033, herewith incorporated by reference, it is often desirable to place two fans downstream from a single signature stream.

The lead-in tapes typically have guide rollers and a drive roller located inside the lead-in tape for guiding and driving the tape. There are guide rollers at the bottom of the lead-in tape where the signature exits, i.e. the exit rollers. In prior art devices, the side-by-side lead-in tape mechanisms have had exit rollers which are co-axial. In other words, the exit rollers are in-line and are the same height from one lead-in tape mechanism to the next side-by-side lead-in tape mechanism.

Also, the exit rollers on one side of a signature are often the same height as the exit rollers on the other side of the signature to ensure that the signatures exit straight.

There are several problems associated with having the exit rollers on one side of a signature the same height as the corresponding exit rollers on the other side of the signature. The even height of the exit rollers causes pounding between the exit rollers, since there is a heavy spring-loaded pressure between the exit rollers. Premature failure of the bearings, tapes or other components may occur, as well as fretting corrosion of the loaded components. Another problem associated with even height of the corresponding exit rollers is slippage of exit roller levers which hold the exit roller. Paper jams are more likely to occur between the heavily loaded exit rollers, which also may lead to lever slippage or premature failure of components. Moreover, the set up of the lead-in tape rollers is difficult because of the required precision to assure that the signatures are properly directed into the fan pockets.

It has therefore been found desirable to reduce the pressure on even height corresponding exit rollers by staggering them, i.e. having the exit roller on one side of a signature be higher or lower than the corresponding exit roller on the other side of the exit roller. This reduces the pressure between the exit rollers. However, the signatures are then often directed or deflected away to the side of the higher exit roller, which can cause problems, especially when a dual fan system is used, because the signatures should exit almost straight so that a signature is directed into the alternating fan pockets of the two fans. This problem is heightened because the thickness of a signature will effect the amount of the deflection when staggered exit rollers are used, therefore often making adjustments necessary when the thickness of the signature is changed.

In U.S. Pat. No. 5,112,033, the bottom rollers of two transport tapes 13 are fixed and slightly staggered, so that one exit roller is higher than its corresponding exit roller. However, the patent is directed to the fans and does not discuss the exit rollers.

U.S. Pat. No. 5,064,180 shows delivery of signatures through signature conveyor belts 14 and 15, the signatures being directly deposited into a stack.

U.S. Pat. No. 5,029,842 to Belanger et. al. discloses a signature delivery apparatus having six side-by-side signature lead-in tapes for delivering signatures to single fans. The exit rollers of the side-by-side lead-in tapes are coaxial about fixed axes.

SUMMARY OF THE INVENTION

An object of the present invention is to reduce pressure between lead-in tape rollers.

A further object of the invention is to reduce vibrations in lead-in tape rollers.

Another object of the invention is to allow for easy delivery of signatures being delivered through a lead-in tape mechanism to a fan.

A still further object of the invention is to provide proper direction of the signatures, regardless of signature thickness.

The present invention therefore provides a folder apparatus comprising: at least two lead in-tape mechanisms arranged side-by-side to one another for delivering a signature; each lead-in tape mechanism having a left lead-in tape and a left exit roller and a corresponding right-lead in tape and a right exit roller, the right exit roller being at a different height than the left exit :roller; and wherein the height of the right exit roller and left exit roller of each lead-in tape mechanism alternates.

In other words, the present invention provides a folder apparatus comprising: a first lead-in tape mechanism having a first left lead in-tape and a first left exit roller, and a corresponding first right lead-in tape and a first right exit roller; the first left exit roller being positioned below the first right exit roller; a second lead-in tape mechanism having a second left lead-in tape and a second left exit roller having a rotating axis, and a corresponding second right lead-in tape and a second right exit roller having a rotating axis; and the second left exit roller being positioned above the second right exit roller.

The staggering and alternating of the lead-in rollers provides several advantages. The staggering—in other words having the corresponding rollers at different heights—minimizes the disadvantages of corresponding exit rollers with the same height. The staggering of the exit rollers reduces the pounding and vibrations between the exit tape rollers. Exit roller levers are less likely to slip in their respective shafts or bolts because of the reduced vibrations. The likelihood of premature failure of bearings, tapes or other components is also reduced, as is fretting or chafing corrosion of the loaded components.

In addition, several advantages are provided by alternating the staggering of the corresponding lead-in tape mechanisms, so that one lead-in tape exit roller is of a different height than the exit roller to the side of it. In other words, the exit rollers of the side-by-side lead-in tapes on one side of the signature are not coaxial, but rather form two axes, one higher than the other.

The alternating of the lead-in rollers is particularly advantageous and ensures that the signature exits the lead-in tape mechanisms straight and unaffected by signature thickness. As stated, the staggering of the lead-in tape may deflect the signature in the direction of the higher exit roller. However, by alternating the staggering of the exit rollers, the next exit roller in the side-by-side arrangement of lead-in tape mechanisms is lower than its corresponding roller. The signature is then deflected by this lead-in tape in the direction opposite that of the lead-in tapes to the side. Across the entire signature width, these deflections therefore tend to cancel each other out, so that the signature exits without deflection. This is so even if the signature thickness is varied.

Therefore the advantage of corresponding exit rollers with an even height— straight delivery—is achieved while reducing the high load pressure between the exit rollers.

BRIEF DESCRIPTION OF THE DRAWINGS

The present invention will be described in greater detail with respect to the drawings below.

DETAILED DESCRIPTION OF THE INVENTION

Figure 1:
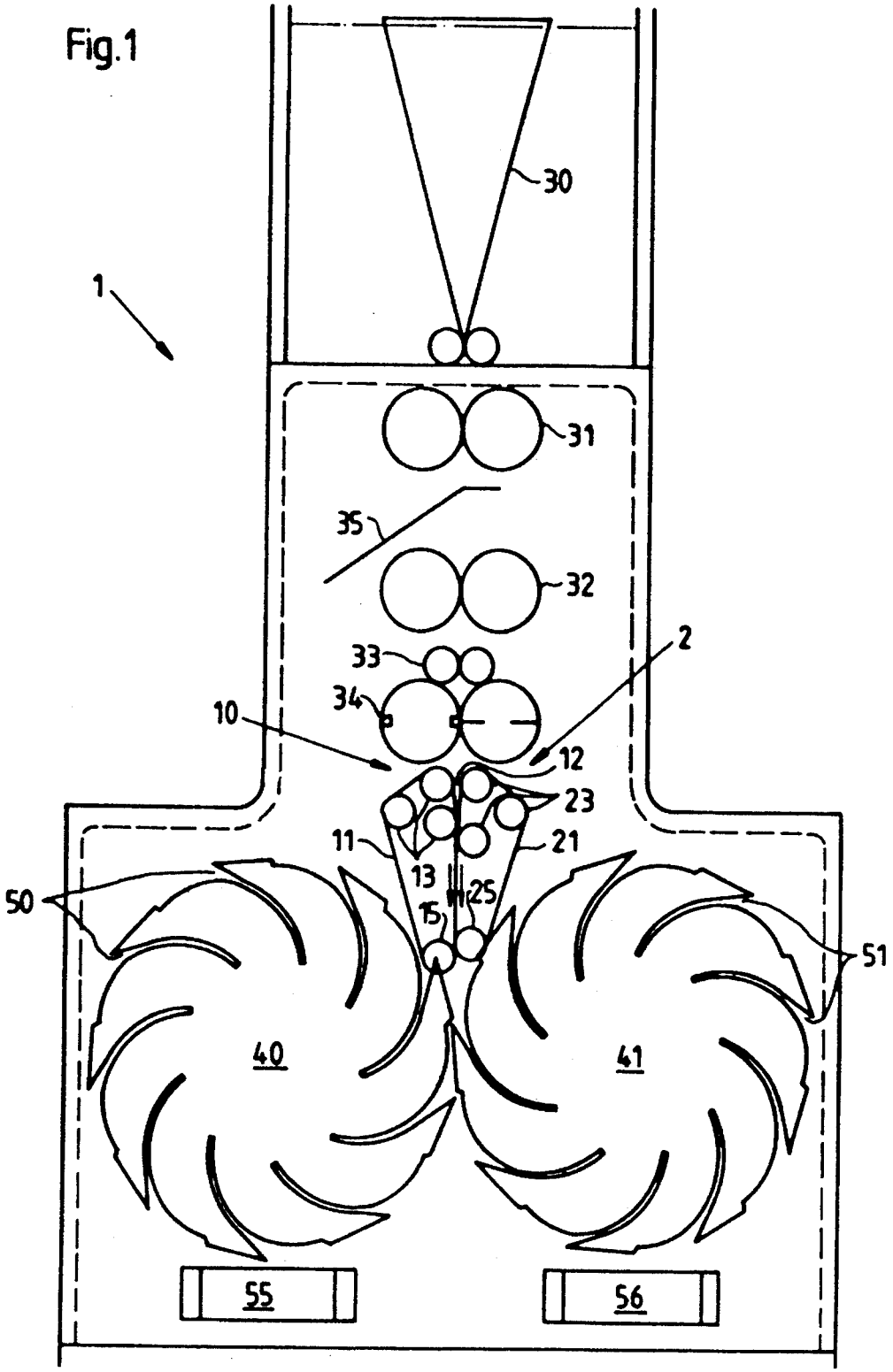
FIG. 1 shows a side-view of a typical folder apparatus for web-fed printing press having the lead-in tape mechanisms of the present invention.

FIG. 1 shows a folder apparatus 1 for a web-fed printing press. The printed webs are conducted over a former 30 and folded. After being folded, the web is fed through the nips of upper and lower draw rollers 31 and 32, respectively, and guide rollers 33 to a cutting cylinder 34, which severs the web to form printed signatures. A web separating device 35 is provided between the upper draw rollers 31 and the lower draw rollers 32.

The signatures are then fed by a lead-in tape system 2 to fan pockets 50 and 51 of fans 40 and 41, respectively. As the fans 40 and 41 rotate, the signatures are deposited to stacks 55 and 56, respectively. The lead-in tape system 2 has a plurality of side-by-side and parallel lead-tape mechanisms, including a first lead-in tape mechanism 10, for grasping the signatures across its width.

The first lead-in tape mechanism 10 has a left lead-in tape 11 and a corresponding right lead-in tape 21, forming a signature passage 12. The lead-in tape mechanism 10 also has left upper rollers 13 and right upper rollers 23, which can comprise guide or drive rollers for guiding and driving the left and right lead-in tapes 11 and 21, respectively. The lead in-tape mechanism 10 also has left exit roller 15 and corresponding right exit roller 25.

Figure 2:
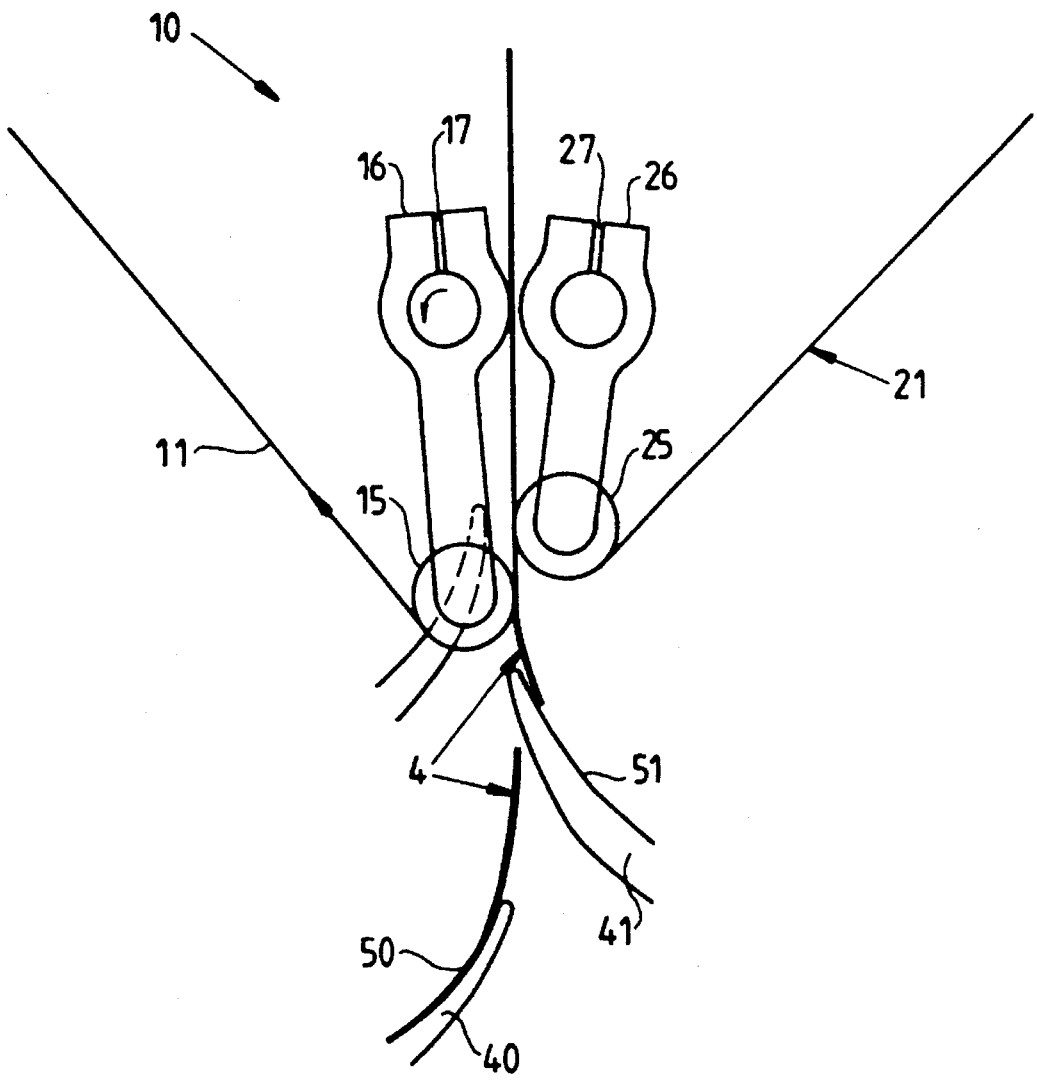
FIG. 2 shows a side view of the staggered exit rollers and exit roller levers of the present invention.

FIG. 2 shows the exit rollers of lead-in tape mechanism 10 in closer view. Left exit roller 15 is staggered from right exit roller 25, so that it is lower than right exit roller 25. Right exit roller 25 is rotatably fixed on a right exit roller lever 26, which is also fixed to a shaft or stud 27. Right exit roller 25 therefore can rotate about its axis, but is otherwise fixed during operation.

Left exit roller 15 is rotatably fixed on a left exit roller lever 16. Left exit roller lever 16 is fixed to a stud 17. The left exit rollers or right exit rollers could also be spring-loaded to act against one another, although this is unnecessary with the alternating of the tape mechanisms.

As shown, the signatures 4 are received in fan pockets 50 and 51 of fans 40 and 41, respectively, as they leave the lead-in tape system.

Figure 3:
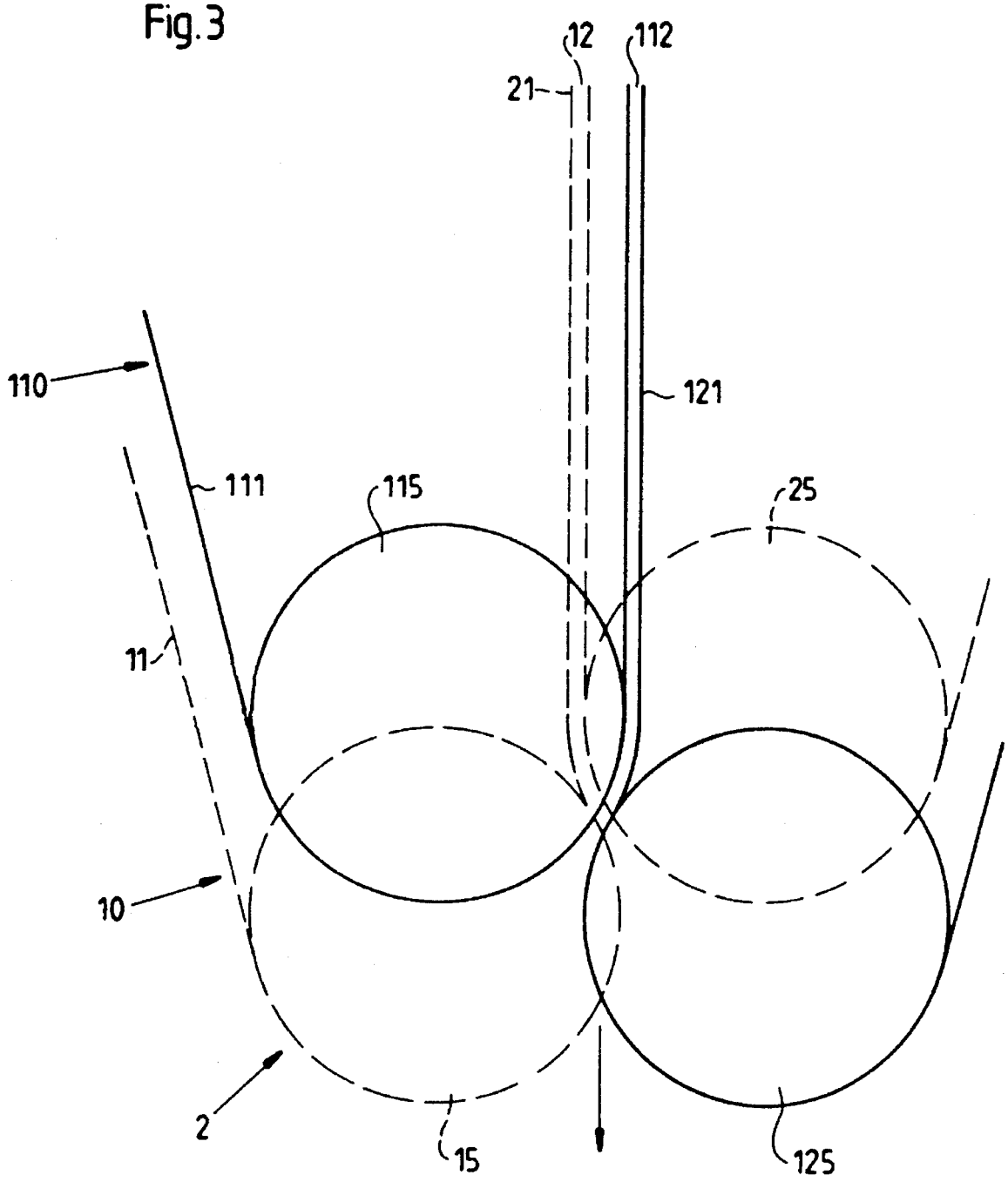
FIG. 3 shows a schematic side view of the staggered exit rollers of the present invention, along with a side-by-side set of exit rollers at an alternate height.
Figure 4:
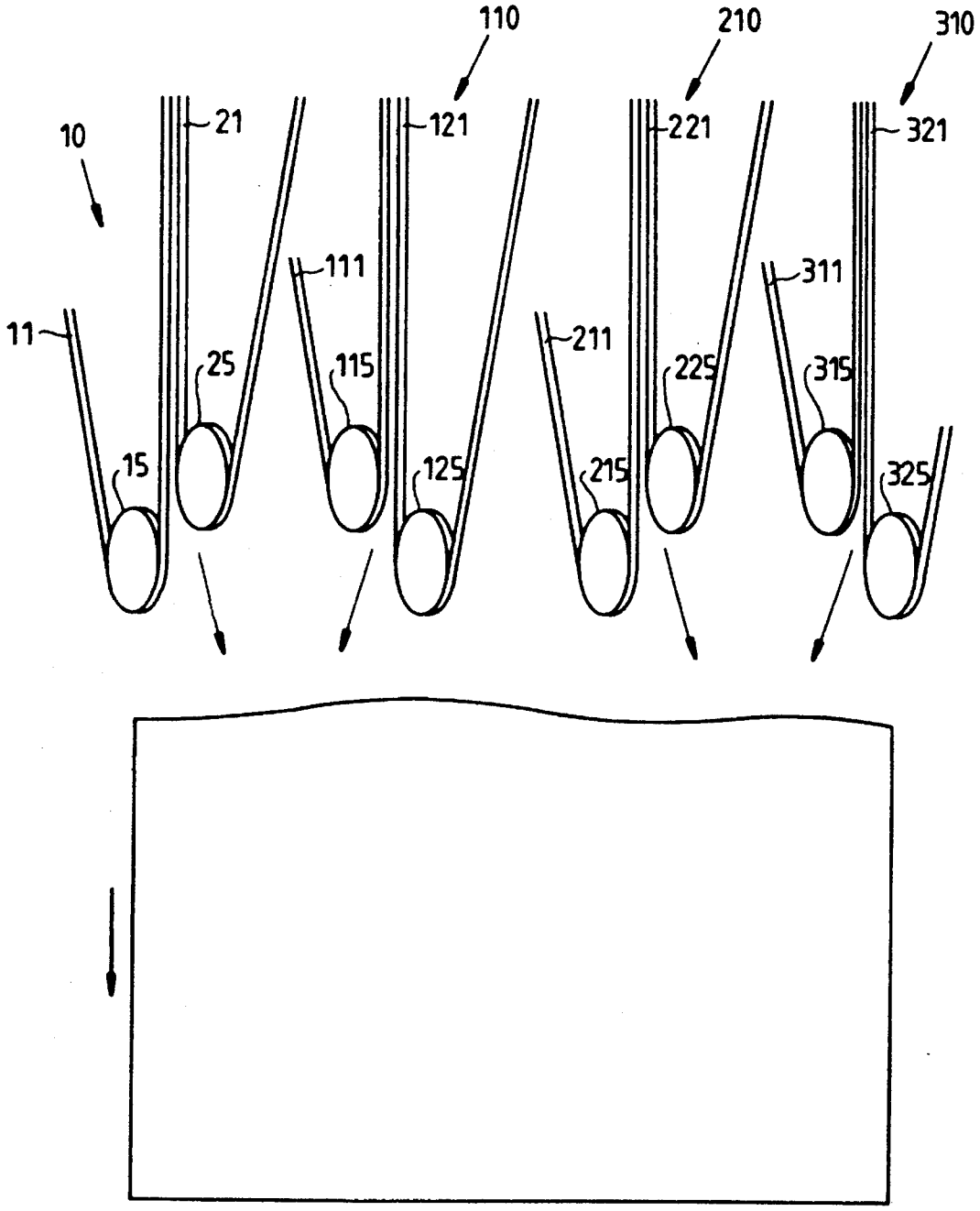
FIG. 4 shows a schematic view of alternating and staggered exit rollers according to the present invention.

While FIG. 1 only shows a first lead-in tape mechanism of the lead-in tape system 2, there are more than one lead-in tape mechanisms arranged side-by side, as shown in FIGS. 3 and 4.

FIG. 3 shows a schematic side view of a second lead-in tape mechanism 110, which is arranged inside and side-by-side to first lead-in tape mechanism 10, shown by the dashed lines in FIG. 3 superimposed over second mechanism 110. Second mechanism 110 has a left lead-in tape 111 and a right lead-in tape 121 forming a signature passage 112. Signature passage 112 can either align perfectly with signature passage 12 of the first mechanism 10, or can be very slightly askew as shown (but which is exaggerated for reasons of clarity in FIG. 3).

As can be seen, left exit roller 115 is staggered from right exit roller 125, so that it is higher than right exit roller 125. Left exit roller 115 and right exit roller 125 are translationally fixed, but can rotate about their axes.

The alternating of the lead-in tape mechanisms 10 and 110 is now shown clearly. "Alternating" means that the left exit rollers of the various lead-in tape mechanisms do not always have the same height, and that the corresponding right exit rollers (which also are staggered to have a different height from their corresponding left exit roller) also do not always have the same height. As shown by FIG. 3, first left exit roller 15 has a different height and is lower than second left exit roller 115, which is axially inside left exit roller 15. And first right exit roller 25 has a different height and is higher than second right exit roller 125.

FIG. 4 shows a plurality of lead-in tape mechanisms arranged side-by-side and parallel to one another, including a first lead-in tape mechanism 10, a second lead-in tape mechanism 110, a third lead-in tape mechanism 210 and a fourth lead-in tape mechanism 310, each having a left lead-in tape 11, 111, 211, 311 and corresponding right lead-in tape 21, 121, 221,321, respectively. The lead in-tape mechanisms 10, 110, 210, and 310 also have left exit rollers 15, 115, 215, 315 and corresponding right exit rollers 25, 125, 225, and 325, respectively. As shown (without fans 40, 41 for clarity), signature 4 exits the rollers straight, with any deflections caused by the staggering of the rollers being effectively canceled out by the alternating of the lead-in tape mechanisms. All of the exit rollers are preferably translationally fixed, but can rotate about their axes. Alternately, rollers 15, 125, 215, 335 may be spring loaded to move against fixed higher exit rollers 25, 115, 225, and 315, respectively, or visa versa.

It should be noted that the lead-in tape mechanisms need not be spaced apart equally from one another, and may be moveable in the axial direction from the other tape mechanisms. Also, the terms "left" and "right" have been used merely for clarity and the folder apparatus can be viewed from either side.

While the present invention has been detailed in the embodiment described above, it is also contemplated the invention may encompass further embodiments than those described.

What is claimed is:

1. A folder apparatus comprising:

at least two lead-in tape mechanisms arranged side-by-side to one another for delivering a signature; each lead-in tape mechanism having a left lead-in tape and a left exit roller and a corresponding right lead-in tape and a right exit roller, the right exit roller being at a different height than the left exit roller; and wherein the relative height of the right exit roller with respect to the left exit roller of one of the at least two lead-in tape mechanism alternates with respect to an adjacent one of the at least two lead-in tape mechanisms.

2. The folder apparatus as recited in claim 1 further comprising:

a left stud and a right stud; and a left exit roller lever and a right exit roller lever;

the left exit roller lever connected at one end to the left stud, and the left exit roller rotatably fixed to the left exit roller lever at the other end;

the right exit roller connected at one end to the right stud, and the right exit roller rotatably fixed to the right exit roller lever at the other end.

3. The folder apparatus as recited in claim 1 wherein the right and left exit rollers are fixed.

4. The folder apparatus as recited in claim 1 wherein the lower of the right and left exit rollers of each lead-in tape mechanism is spring loaded in the direction of the higher exit roller.

5. The folder apparatus as recited in claim 1 further comprising a pair of fans for receiving the signature.

6. A folder apparatus comprising:

a first lead-in tape mechanism having a first left lead in-tape and a first left exit roller, and a corresponding first right lead-in tape and a first right exit roller, the first right and left lead-in tapes forming a first signature passage for delivery of a signature;

the first left exit roller being positioned below the first right exit roller;

a second lead-in tape mechanism having a second left lead-in tape and a second left exit roller having a rotating axis, and a corresponding second right lead-in tape and a second right exit roller having a rotating axis, the second right and left lead-in tapes forming a second signature passage for delivery of the signature; and the second left exit roller being positioned above the second right exit roller.

7. The folder apparatus as recited in claim 6 further comprising a pair of fans for receiving the signature.

8. The folder apparatus as recited in claim 6 wherein the first right exit roller and second left exit rollers are fixed; the first left exit roller is spring loaded in the direction of the first right exit roller; and the second right exit roller is spring loaded in the direction of the second left exit roller.

9. The folder apparatus as recited in claim 6 wherein the first right and first left exit rollers and second right and second left exit rollers are fixed.

10. The folder apparatus as recited in claim 6 further comprising a third lead-in tape mechanism positioned axially next to the second lead-in tape mechanism, the third lead-in tape mechanism having the same configuration as the first lead-in tape mechanism.

* * * * *